US008783155B2

(12) United States Patent
Green

(10) Patent No.: US 8,783,155 B2
(45) Date of Patent: Jul. 22, 2014

(54) STACKED PROJECTILE LAUNCHER AND ASSOCIATE METHODS

(75) Inventor: Daniel William Green, Darra (AU)

(73) Assignee: Metal Storm Limited, Darra (AU)

( * ) Notice: Subject to any disclaimer, the term of this patent is extended or adjusted under 35 U.S.C. 154(b) by 98 days.

(21) Appl. No.: 13/148,264

(22) PCT Filed: Feb. 8, 2010

(86) PCT No.: PCT/AU2010/000132
§ 371 (c)(1),
(2), (4) Date: Aug. 5, 2011

(87) PCT Pub. No.: WO2010/088741
PCT Pub. Date: Aug. 12, 2010

(65) Prior Publication Data

US 2011/0290102 A1 Dec. 1, 2011

(30) Foreign Application Priority Data

Feb. 6, 2009 (AU) ..... 2009900462

(51) Int. Cl.
*F41A 21/28* (2006.01)
*F41A 21/00* (2006.01)

(52) U.S. Cl.
USPC ..... 89/16; 89/14.7; 102/360; 102/438

(58) Field of Classification Search
USPC ..... 89/16, 14.05, 14.7, 14.8; 102/360, 438; 472/66; 42/76.01, 77
See application file for complete search history.

(56) References Cited

U.S. PATENT DOCUMENTS

| | | | |
|---|---|---|---|
| 1,480,957 | A | 1/1924 | Schneider |
| 1,559,183 | A | 10/1925 | Rimailho |
| 1,864,374 | A | 6/1932 | Romberg et al. |
| 2,099,993 | A | 11/1937 | Tauschek |
| 3,139,795 | A | 7/1964 | Altschuler |
| 3,307,451 | A | 3/1967 | Bucklisch et al. |
| 3,381,403 | A | 5/1968 | Murdoch |
| 3,395,478 | A | 8/1968 | Harvey |
| 3,412,681 | A | 11/1968 | Schirneker |
| 3,416,252 | A | 12/1968 | Silsby |
| 3,421,244 | A | 1/1969 | Reed |
| 3,611,867 | A | 10/1971 | Silsby |
| 3,718,070 | A | 2/1973 | Schneider, Jr. |
| 3,730,050 | A | 5/1973 | Goldin et al. |
| 3,808,941 | A | 5/1974 | Biggs |
| 3,815,271 | A | 6/1974 | Lynn |
| 3,946,637 | A | 3/1976 | Campagnuolo et al. |
| 3,952,658 | A | 4/1976 | Broyles |
| 4,549,487 | A | 10/1985 | Jensen |
| 4,621,579 | A | 11/1986 | Badura et al. |
| 4,733,597 | A | 3/1988 | Upham |

(Continued)

FOREIGN PATENT DOCUMENTS

| | | |
|---|---|---|
| DE | 1428655 | 12/1968 |
| DE | 2936861 | 3/1980 |

(Continued)

*Primary Examiner* — Michael David
(74) *Attorney, Agent, or Firm* — Blakely, Sokoloff Taylor & Zafman LLP

(57) ABSTRACT

Provided is a barrel insert for use with a barrel containing a plurality of axially stacked projectiles. The barrel insert has a proximal and a distal end, the distal end adapted to engage a proximally disposed projectile disposed in the barrel. The barrel insert also defines an expansion volume for propellant gases for launching the proximally disposed projectile at a predetermined velocity.

19 Claims, 3 Drawing Sheets

(56) References Cited

U.S. PATENT DOCUMENTS

| | | | |
|---|---|---|---|
| 4,878,432 | A | 11/1989 | Mikhail |
| 5,052,270 | A | 10/1991 | Travor et al. |
| 5,097,614 | A | 3/1992 | Strong |
| 5,992,291 | A | 11/1999 | Widder et al. |
| 6,138,395 | A | 10/2000 | O'Dwyer |
| 7,475,636 | B2 | 1/2009 | O'Dwyer et al. |
| 7,698,849 | B2 | 4/2010 | O'Dwyer et al. |
| 2004/0231219 | A1 | 11/2004 | O'Dwyer |
| 2004/0244258 | A1 | 12/2004 | O'Dwyer et al. |
| 2006/0130695 | A1 | 6/2006 | O'Dwyer |

FOREIGN PATENT DOCUMENTS

| | | |
|---|---|---|
| GB | 124801 | 4/1919 |
| GB | 1534134 | 11/1978 |
| WO | WO98/28587 | 7/1998 |
| WO | WO01/90680 | 11/2001 |
| WO | WO04/001326 | 12/2003 |
| WO | WO2006/012705 | 2/2006 |

STACKED PROJECTILE LAUNCHER AND ASSOCIATE METHODS

CROSS-REFERENCES TO RELATED APPLICATIONS

This application is a U.S. National Phase application under 35 U.S.C. §371 of International Application No. PCT/AU2010/000132, filed Feb. 8, 2010, which claims priority to Australian patent application No. 2009900462, filed Feb. 6, 2009. The disclosure of the above-identified applications is incorporated by reference herein in its entirety.

BACKGROUND OF THE INVENTION

This invention relates to stacked projectile launchers in general. Specifically, the invention includes a barrel insert, a barrel assembly, a method of firing axially stacked projectiles, a method of configuring a stacked projectile launcher, and a stacked projectile launcher.

DESCRIPTION OF THE PRIOR ART

Reference in this specification to any prior publication (or information derived from it), or to any matter which is known, is not, and should not be taken as an acknowledgment or admission or any form of suggestion that the prior publication (or information derived from it) or known matter forms part of the common general knowledge in the field of endeavour to which this specification relates.

The current Applicant has developed a number of stacked projectile launcher systems. Certain applications of these types of stacked projectile launcher systems require that projectiles fired from a single barrel have substantially similar muzzle velocities.

For example, airburst grenades or similar projectiles can be fired from these stacked projectile weapons. In these applications, it becomes important that each projectile leaves a barrel of the weapon at similar muzzle velocities as such projectiles can have fuses or timing circuitry for arming or detonating a payload of the projectile after a certain amount of time has elapsed after the projectile has been fired. If the stacked projectiles have different muzzle velocities when fired, it can become difficult to configure proper arming or detonation timing. This difficulty similarly applies to launching of stacked fireworks.

Another application includes less than lethal projectiles which are required to leave the barrel with consistent predetermined muzzle velocities such that the desired terminal effect can be achieved.

Range and trajectory are in part determined by muzzle velocity, particularly with low muzzle velocity applications. But even with low muzzle velocity applications, up to 400 m/s, the pressures generated within the barrel can be very high to extreme, e.g. reaching pressures in the 10 s of MPa to 100 s of MPa depending on the mass of the projectile. This makes consistent muzzle velocities difficult to achieve, particularly for travelling charge projectiles and particularly where the same weapon is to fire a variety of projectiles with, for example, varying masses.

Furthermore, achieving consistent muzzle velocity in stacked projectile launchers is particularly difficult to achieve in applications where the projectiles are loaded into the launcher by hand. The friction between the projectile and barrel wall must be sufficiently low for the projectile to be inserted manually, i.e. a loose fit, whilst at the same time allowing sufficient friction between the barrel wall and projectile to allow for pressure generated sealing between the barrel wall and projectile when the projectile is fired.

SUMMARY OF THE PRESENT INVENTION

According to a first aspect of the invention there is provided a barrel insert for use with a barrel containing a plurality of axially stacked projectiles, the barrel insert having a proximal and a distal end, the distal end adapted to engage a proximally disposed projectile disposed in the barrel, the barrel insert defining an expansion volume for propellant gases for launching the proximally disposed projectile at a predetermined velocity.

Typically, the distal end includes a circumferential groove adapted to engage a clip on the projectile disposed in the barrel.

Typically, the expansion volume is defined in part by a chamber within the insert, the insert including at least one aperture in communication with the chamber.

Typically, the at least one aperture is disposed in the proximal end of the insert.

Typically, a portion of the proximal end of the barrel insert extends from the barrel, in use.

Typically, the barrel insert includes a breech closure for use with the barrel.

Typically, the barrel insert includes a spigot extending from the proximal end.

Typically, the chamber extends into the spigot.

Typically, the barrel insert includes a rear portion attached to an end of the spigot, the chamber extending through the spigot and into the rear portion.

Typically, the rear portion is configured such that a volume thereof is variable.

Typically, the barrel insert includes a compressible seal adjacent the proximal end.

According to a further aspect of the invention there is provided a barrel assembly for a projectile launcher including a barrel having a proximal end and a distal end, the barrel including a plurality of selectively launchable projectiles axially disposed therein, a most proximally disposed projectile in engagement with the barrel insert of the first aspect of the invention.

Typically, each of the projectiles includes a discrete selectively ignitable propellant charge.

According to a further aspect of the invention there is provided a barrel assembly for a stacked projectile launcher, said barrel assembly configured to receive a plurality of axially stacked projectiles, each projectile associated with a discrete selectively ignitable propellant charge, the barrel assembly including:

- a barrel for receiving the stacked projectiles, said barrel and projectiles together defining discrete expansion volumes for each propellant charge; and
- a barrel closure configured so that an expansion volume for the projectile most proximally disposed to the closure is predetermined in proportion to the expansion volumes for the other projectiles in order to minimize muzzle velocity variation between said projectiles when each propellant charge is ignited.

Typically, the barrel closure has a proximal and a distal end, the distal end adapted to engage a proximally disposed projectile disposed in the barrel.

Typically, the proximal end of the barrel closure includes a chamber in communication with apertures defined radially around a circumference of the barrel closure, said chamber providing additional expansion volume.

According to a yet further aspect of the invention there is provided a barrel assembly for a stacked projectile launcher, the barrel assembly including;

a barrel; and a plurality of axially stacked projectiles, each projectile associated with a discrete selectively ignitable propellant charge, said barrel and projectiles together defining discrete expansion volumes for each propellant charge, wherein the barrel is configured so that an expansion volume for the last projectile disposed therein is predetermined in proportion to the expansion volumes for the other projectiles in order to minimize muzzle velocity variation between said projectiles when each propellant charge is ignited.

Typically, the barrel assembly includes a cartridge.

According to another aspect of the invention there is provided a method of firing a plurality of axially stacked projectiles from a single barrel, each projectile associated with a discrete selectively ignitable propellant charge, the barrel and projectiles together defining discrete expansion volumes for each propellant charge, the method including the steps of:

providing a volume behind the rearmost projectile in the barrel, said volume predetermined to be proportional to the expansion volumes defined for the other projectiles; and firing the projectiles sequentially, wherein the volume behind the rearmost projectile is predetermined to minimize muzzle velocity variation between the projectiles when each propellant charge is ignited.

According to a yet further aspect of the invention there is provided a method of configuring a stacked projectile launcher, the launcher having a barrel with a plurality of axially stacked projectiles, each projectile associated with a discrete selectively ignitable propellant charge, the barrel and projectiles together defining discrete expansion volumes for each propellant charge, said method including the step of providing a volume behind the rearmost projectile in the barrel, said volume predetermined to be proportional to the expansion volumes defined for the other projectiles to minimize muzzle velocity variation between the projectiles when each propellant charge is ignited.

Typically, the step of providing the volume includes the step of inserting a barrel insert into the barrel for locating the rearmost projectile in a predetermined position in the barrel.

Typically, the step of providing the volume includes the step of providing a barrel closure behind the rearmost projectile, wherein the barrel closure at least partially defines the volume.

Typically, the volume is variable.

According to a yet further aspect of the invention there is provided a stacked projectile launcher including a barrel assembly according to any of the other aspects of the invention above.

BRIEF DESCRIPTION OF THE DRAWINGS

An example of the present invention will now be described with reference to the accompanying drawings, in which.

DETAILED DESCRIPTION OF PREFERRED EMBODIMENTS

Figure 1:
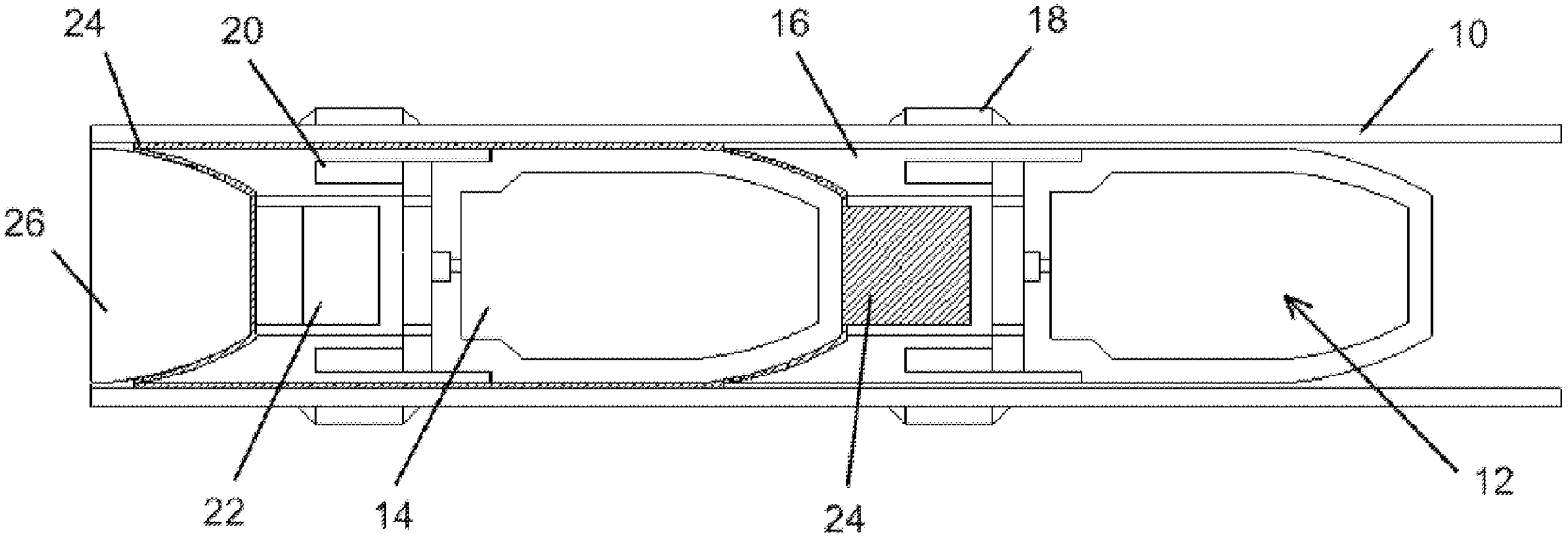
Figure 1 (prior art)
FIG. 1 shows a diagrammatic side-sectional representation of a prior art barrel assembly of a stacked projectile launcher.

With reference now to FIG. 1 of the drawings, a prior art barrel assembly is shown. The barrel assembly includes a barrel 10 and a plurality of projectiles 12 axially stacked within the barrel 10. The barrel 10 is closed at one end by means of barrel closure 26. The stacked projectiles 12 are disposed in the barrel 10 and abut, as a whole, against the closure 26 as shown.

In the prior art shown, each projectile 12 includes a payload 14 and a tail portion 16. The payload is typically a high-explosive, an incendiary, a smoke-producing material, a sensor package, fireworks, less than lethal slug or sponge, a solid slug, or the like. It is to be appreciated that the payload 14 may be a wide variety of materials and/or devices as is readily understood in the art. The tail portion 16 of this prior art stacked projectile launcher includes a propellant charge 22 via which the relevant projectile is launched from the barrel 10. In other prior art, the propellant charges are located external to the barrel. The present invention also applies to external propellant stacked projectile launchers, whereby the propellant is arranged in chambers external to the barrel.

The prior art launcher shown employs induction ignition of the propellant charges. The barrel 10 includes a plurality of primary inductors 18 associated with corresponding secondary inductors 20 in each projectile 12. The primary inductors facilitate ignition of the respective propellant charges 22 of each projectile by means of the associated secondary inductor 20 in the tail portion of the projectiles 12. The specifics of a relevant firing system are beyond the scope of this description and will not be described in any detail.

It is to be appreciated that the propellant charges 22 of the different projectiles typically includes a similar amount of combustible material, e.g. propellant, etc., as the projectiles are typically mass-produced. Providing projectiles with differing propellant loads depending on their firing position in the barrel is very undesirable leading to unmanageable inventories and complex logistics and a more complex and less usable product.

A person skilled in the art of internal ballistics will also recognize that an ideal propellant burn is difficult to achieve with many variables to consider including propellant type, propellant volume, propellant load density, static and kinetic friction, inertia of the projectile, peak pressure, barrel diameter and length, etc. This is particularly difficult for travelling charge projectiles.

As with single shot projectile launchers, the entire length of the barrel is desirably utilized by expanding gasses for pushing the projectile along the barrel similar to a piston in a piston engine. However in stacked projectile launchers, the volume available rearwardly from the propellant charge when the projectile is launched is less predictable due to the varying positions of the projectiles along the barrel inherent for such stacked projectiles.

The tail portions 16 define an expansion volume 24 for expansion gasses produced when a propellant charge is ignited to propel a projectile from the barrel 10. Such expansion volume generally includes any space between the tail portion of a leading projectile. Further expansion occurs between a trailing projectile and an inside bore of the barrel 10, as "blowback" may occur from a leading projectile past a trailing projectile in the direction of the barrel closure. This is particularly so where projectiles are to be manually pushed into the barrel and the projectiles will necessarily be a relatively loose fit into the barrel. Hence for manual reload of a large caliber, the expansion volume available can be large.

As previously mentioned, it is important that the muzzle velocities of mass produced stacked projectiles are substantially similar when they are launched from the barrel 10. The Applicant has identified that there may be discrepancies in muzzle velocities between the leading projectiles launched from the barrel 10 and that of the last trailing projectile disposed most proximate to the barrel closure 26. These discrepancies may be attributed to differences in expansion volumes due to "blowback" of ignition gasses down the barrel 10, as mentioned above.

It has been found from extensive testing of a configuration of projectiles that the substantial volume of "blowback" extends the length of approximately one trailing projectile as shown by the shading in FIG. 1. Similarly, the force applied to a stack of projectiles by firing the lead projectile causes the stack to compress. This compression may occur due to e.g. the wedge sealing inventions described in the Applicant's previous patent applications. Such compression may affect the volume available for expansion gasses. The rate of compression may also effect the expanding of the gasses for propelling the projectile. (The skilled addressee will recognize that the internal ballistics of a travelling charge projectile in a compressible stack is very complex.) Of course, such an effect on the expansion volume rearward of a projectile is not present for the last projectile. In a wedge sealing arrangement, the portion of the expansion volume 24 shown in FIG. 1 that is further downstream from the wedge seal of the trailing projectile will be substantially eliminated.

Figure 2:
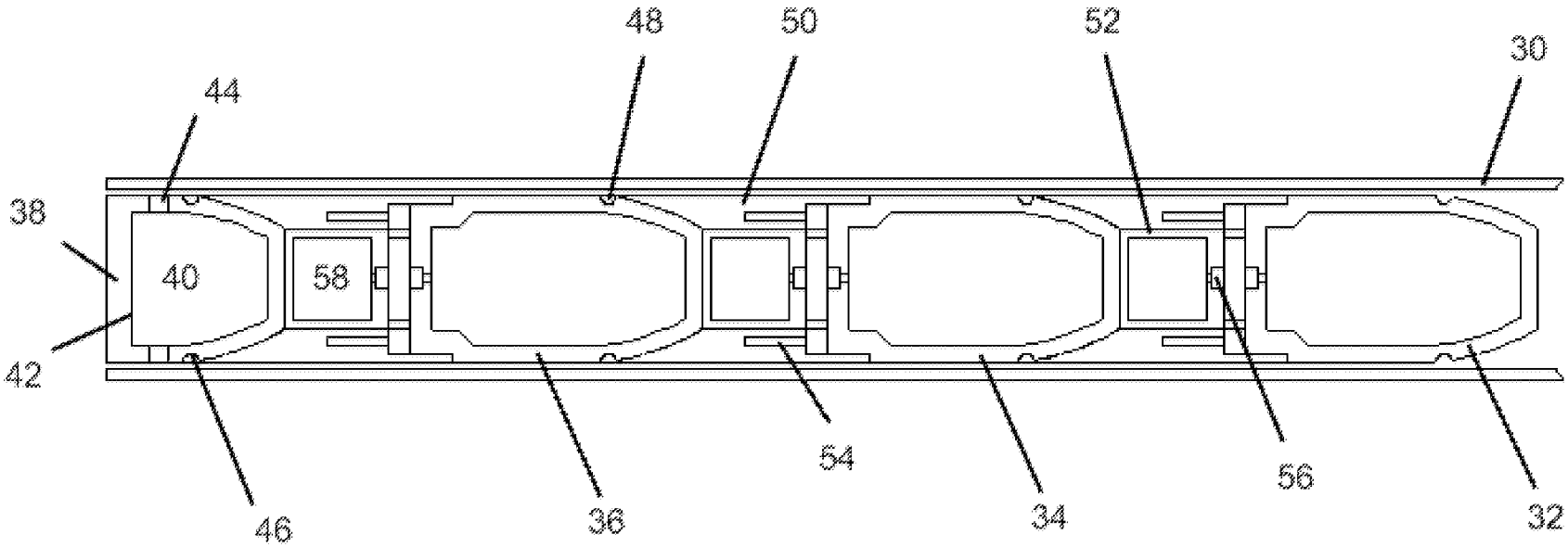
FIG. 2 shows a diagrammatic side-sectional representation of a of a barrel assembly of a stacked projectile launcher.

With reference now to FIG. 2 of the drawings, there is shown an embodiment of the invention including a barrel 30 with projectiles 32, 34, 36 axially stacked in the barrel 30. The projectiles 32, 34, 36 each include a tail portion 50 with a propellant charge 58 in propellant chambers 52. Also included are the secondary inductors 54 with primer 56 for inductive ignition of the propellant charge 58. Each projectile also includes a circumferential groove around the nose of the projectile and a clip or clips 48 whereby the projectiles may be clipped together to e.g. prevent separation during transport and firing as well as assisting propellant burn prior to release during use.

One embodiment of the barrel insert 38 is shown. Barrel insert 38 generally has a proximal and a distal end, the distal end adapted to engage a proximally disposed projectile 36 disposed in the barrel 30. The barrel insert 38 defines an expansion volume 40 for propellant gases for launching the proximally disposed projectile 36 at a predetermined velocity from the barrel 30.

By configuring the barrel insert 38 to define a certain expansion volume 40 for the gasses released by ignition of the propellant charge of the last projectile 36, it is possible to control the muzzle velocity of the last projectile 36.

The distal end of the insert 38 also includes a circumferential groove 46 adapted to engage a clip or clips on the last projectile 36 disposed in the barrel 30. This groove 46 is similar to grooves defined by the leading projectiles 34, 32 and facilitates stacking of the projectiles in the barrel. The volume 40 is defined in part by a chamber 42 within the insert 38, as shown, with the insert 38 including apertures 44 communicating with the chamber 40. In another embodiment, the insert 38 may include a single aperture (not shown) through the centre of the distal end of the insert 38.

The volume is also defined in part by the apertures 44 and can be varied be changing the number of apertures, their diameter and the thickness of the wall through which they extend. These variables of the apertures may also be configured to control the rate of flow of expanding propellant gasses into the chamber 42. In one embodiment, the apertures 44 are disposed in the proximal end of the insert 38 and are positioned proximally of the groove 46, as shown.

The volume 40 is also defined in part by the volume between the barrel insert 38 and the bore of the barrel. This volume may generally be regarded as surrounding the proximal end of the insert 38 extending rearward from the groove 46. By increasing the axial length of the proximal end, the volume surrounding the proximal end, the volume defined by the apertures 44 and the volume of chamber 42 can also be varied. This adjustment, or tuning, of the projectile launcher may be completed during development or as a factory setting of the launcher or may occur in the field. Field adjustment may include a variable barrel insert 38 where a volume in the insert or a dimension of the insert can be varied. Alternatively, adjustment in the field may be effected through using interchangeable inserts 38 or interchangeable parts thereof. Each insert 38 or interchangeable part thereof has been set for a particular projectile.

Increasing the axial length of the insert 38 that is rearward of the groove 46 will move the stack of projectiles forward in the barrel. Alternatively, where an initiation means, e.g. the primary inductors are fixed, the barrel may be extended rearwardly so the e.g. secondary coils 54 remain in alignment with the primary coils. In external propellant stacked projectile launchers the projectiles similarly may need to remain in alignment with their respective external propellant chamber.

Predictable burning of the propellant is important for predictable muzzle velocity. The embodiment of FIG. 2 shows the nose of the barrel insert 38 forward of the groove 46 matching the shape of the nose of the projectiles forward of their grooves. The benefit of such a preferred arrangement is to ensure that at least the initial stages of the propellant burn of the last projectile and the expansion of the respective gasses will match that of the leading projectiles. As such, the volume available to expanding propellant gasses between the leading projectiles will be similar to the volume between the last projectile and the distal end of the barrel insert 38; in particular the portion of the distal end forward of the groove 46. In the arrangement shown in FIG. 2, there is little expansion volume between projectiles. In other arrangements there may be a substantially larger volume between projectiles and accordingly between the last projectile and barrel insert 38.

As described above, the effect of the compressible stack on the available expansion volume rearward of a projectile is not present for the last projectile. Hence the volume defined by the barrel insert 38 may necessarily need to be larger than the static expansion volume 24 shown in FIG. 1.

It is to be appreciated that, in different embodiments of the invention, the barrel insert 38 may form a breech closure for use with a barrel. In such an embodiment, the projectiles may be loaded into the barrel by removing the breech closure (the barrel insert 38). As such, the barrel insert 38 is configured for detachment from the barrel to allow access to the breech so formed. The insert 38 may include an external thread for engaging a corresponding internal thread on the barrel. The thread may be configured for complete attachment to detachment in a quarter-turn thread arrangement. A bayonet type coupling, clamp with over-centre toggle, or other coupling may be included instead of a threaded coupling.

Accordingly, the volume 40 can be predetermined so that the expansion volume for the last projectile 36 is proportional to the discrete expansion volumes defined by the other leading projectiles and the barrel. This minimizes muzzle velocity variation between said projectiles when each propellant charge is ignited.

Figure 3:
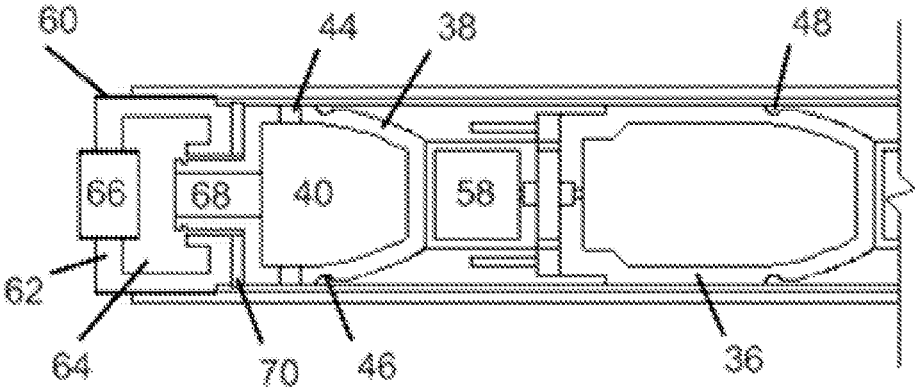
FIG. 3 shows a diagrammatic side-sectional representation of a further example of a barrel assembly of a stacked projectile launcher.

FIG. 3 shows a barrel insert 38 including a breech closure. As in the embodiment of FIG. 2, the insert includes a thread 60 for attachment to the barrel. The chamber may include a mechanism for varying the volume. In this example of the embodiment the insert includes a plug 66 threadably engaged with the insert. By screwing the plug 66 further into the insert 38 the volume can be decreased and vice versa.

The barrel insert 38 may comprise a rear portion 62 and a forward portion with the forward portion including the distal end. A shoulder on the insert 38, on the rear portion in this embodiment, limits the movement of the insert 38 into the barrel.

In an alternative arrangement for varying the size of the volume, the two portions may be removably attached together such that the forward portion (or rearward portion) may be exchanged with a different forward portion (or rearward portion). The exchanged forward portion may have been tuned, e.g. have different dimensions, for use with a different projectile or propellant load.

FIG. 3 shows a proximal end may include a spigot 68 for attaching the portions together. The spigot 68 may be hollow and define part of the volume of chamber 42. The spigot 68 may be open at both ends to allow the chamber 42 to communicate with a chamber 64 in the rear portion 62.

When functioning as a breech closure, the insert 38 may also seal the breech. For sealing the breech, the embodiment of FIG. 3 includes an expandable seal 70 surrounding the spigot 68 between the forward portion and rear portion 62. For a dynamic sealing of the breach, the spigot 68 may be slidably attached to the rear portion. During firing of at least the last projectile, the forward portion slides relatively to the rear portion 62, compressing the seal 70 which expands into sealing engagement with surrounding surfaces. The slidable attachment may include a clip such as a cir-clip in clip groove 90 (see FIG. 6).

Figure 4:
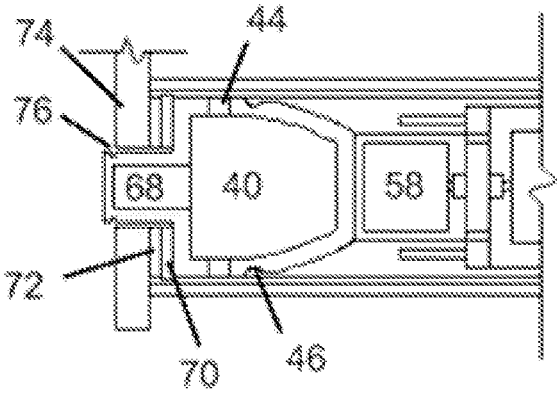
FIG. 4 shows a diagrammatic side-sectional representation of a yet further example of a barrel assembly of a stacked projectile launcher.

Another embodiment of the invention is shown in FIG. 4. In this embodiment the insert 38 includes the breech closure. This includes a breech mechanism 74, such as a breech block or breech plate, which holds the insert in position in the barrel. The parts of the breech mechanism which fix the breech block relative to the barrel are not included in this description. The breech block may extend partially into the barrel. As shown in FIG. 4, this embodiment may include the sliding spigot 68, clip 76 and compressible seal 70 described in respect to FIG. 3. A further washer 72 may be added where the breech block does not extend into the barrel. The washer provides for a more controlled expansion of the seal 70.

Figure 5:
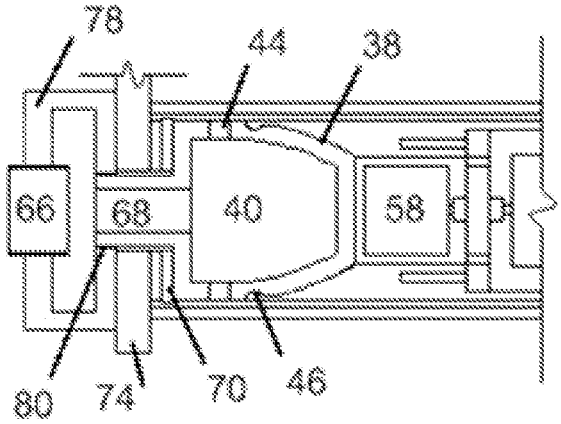
FIG. 5 shows a diagrammatic side-sectional representation of another example of a barrel assembly of a stacked projectile launcher.

A further variation of the embodiment of FIG. 4 is shown in FIG. 5. The spigot 68 may be open at both ends with the rear end attaching to a rear portion 78 on the rear side of the breech block 74. As described above the rear portion may be arranged to be readily exchangeable with a different rear portion 78 for firing different projectiles, propellant loads or ranges. Alternatively or in addition, the rear portion 78 may include a plug 66 as shown in FIG. 5 and described above. The rear portion is shown as being attached to the forward portion spigot by a coupling 80 such as a threaded, bayonet or other coupling. If the rear portion is not readily exchangeable a clip and groove 76 (see FIG. 4) connection could be used. Should the embodiment include a readily exchangeable rear portion as well as the sliding spigot 68 and expandable seal 70 mechanism, the spigot may also include a cir-clip between the rear portion 78 and breech bock 72.

Figure 6:
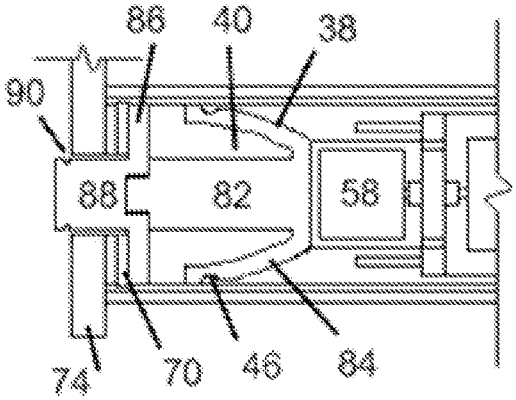
FIG. 6 shows a diagrammatic side-sectional representation of an additional example of a barrel assembly of a stacked projectile launcher.
Figure 7:
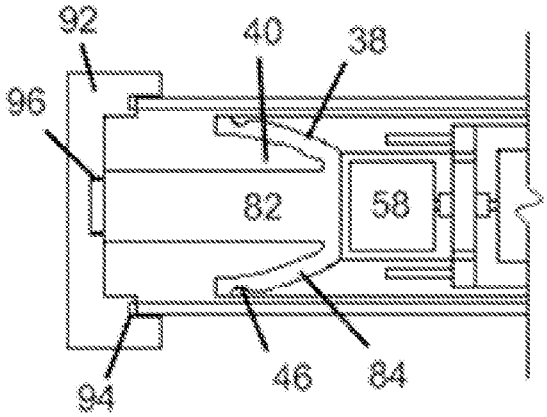
FIG. 7 shows a diagrammatic side-sectional representation of a yet further example of a barrel assembly of a stacked projectile launcher.

An alternative embodiment of the invention is shown in FIGS. 6 and 7. The proximal end includes a pillar 82 to support the distal end in position rather than the apertured cylinder type support of the embodiments shown in FIGS. 3 to 5. The example of this embodiment shown in FIG. 6 includes the breech closure. The breech closure may be any of those previously described or combination of features thereof. FIG. 6 shows a breech closure similar to the embodiment of FIG. 4. Namely, a breech block 74 and slidable spigot 88 and expandable seal 70. The rear portion includes spigot 88 and a flange 86 for compressing expandable seal 70 and is attached to pillar 82. As described above for other embodiments the spigot 88 may be held on the breech block 74 by cir-clip 90.

Alternatively, as shown in FIG. 7, the pillar 82 may be directly attached to the breech block 92. The attachment may be readily releasable so that the distal end and pillar 82 (or a portion of the pillar) may be readily exchanged. Or, the breech block 92 may be readily exchanged. In the example of the embodiment shown in FIG. 7 the breech block 92 in any of the embodiment may define some of the volume. In this example of such an embodiment, such a volume may be external to the barrel. FIG. 7 also shows an alternative sealing arrangement with seal 94.

The spigot 68, examples of which are shown in FIGS. 3 to 5 may be integral with (or part of) the rear portion rather than the forward portion. Similarly, the pillars 82 of FIGS. 6 and 7 may be integral with (or part of) the rear portion (FIG. 6) or the breech block (FIG. 7). Or the pillar may include separable ends with one end being a part of the forward portion and the other end part of the rear portion (FIG. 6) or breech block (FIG. 7)

The invention also provides for a method of configuring a stacked projectile launcher in this manner. The launcher has a barrel with a plurality of axially stacked projectiles, with each projectile associated with a discrete selectively ignitable propellant charge, as described above. The barrel and projectiles together define discrete expansion volumes for each propellant charge. By providing the volume predetermined to be proportional to the expansion volumes defined for the other projectiles behind the rearmost projectile in the barrel, it is possible to minimise muzzle velocity variation between the projectiles when each propellant charge is ignited.

Persons skilled in the art will appreciate that numerous variations and modifications will become apparent. All such variations and modifications which become apparent to persons skilled in the art should be considered to fall within the spirit and scope of the invention broadly appearing before and now described in more detail.

It is to be appreciated that reference to "one embodiment" or "an embodiment" of the invention is not made in an exclusive sense. Accordingly, one embodiment may exemplify certain aspects of the invention, whilst other aspects are exemplified in a different embodiment. These examples are intended to assist the skilled person in performing the invention and are not intended to limit the overall scope of the invention in any way unless the context clearly indicates otherwise.

Features that are common to the art are not explained in any detail as they are deemed to be easily understood by the skilled person. Similarly, throughout this specification, the term "comprising" and its grammatical equivalents shall be taken to have an inclusive meaning, unless the context of use clearly indicates otherwise.

The invention claimed is:

1. A barrel insert for use with a barrel containing a plurality of axially stacked projectiles, the barrel insert comprising:

a proximal end; and a distal end, the distal end adapted to engage a proximally disposed projectile of the plurality of axially stacked projectiles disposed in the barrel and including a wall across the distal end of the barrel insert, the barrel insert defining an expansion volume for propellant gases for launching the proximally disposed projectile at a predetermined velocity, wherein the expansion volume is in part defined by a proximal side of the wall.

2. The barrel insert according to claim 1, wherein the distal end includes a circumferential groove adapted to engage a clip on the proximally disposed projectile disposed in the barrel.

3. The barrel insert according to claim 1, wherein the expansion volume is defined in part by a chamber within the insert, a distal end of the chamber including the wall and the insert including at least one aperture in communication with the chamber.

4. The barrel insert according to claim 3, wherein the at least one aperture is disposed in the proximal end of the insert.

5. The barrel insert according to claim 1, wherein a portion of the proximal end of the barrel insert extends from the barrel, in use.

6. The barrel insert according to claim 1, further including a breech closure for closing the breech of the barrel.

7. The barrel insert according to claim 1, further including a spigot extending from the proximal end.

8. The barrel insert according to claim 7, wherein the volume extends into the spigot.

9. The barrel insert according to claim 8, further including a rear portion attached to an end of the spigot, the chamber extending through the spigot and into the rear portion.

10. The barrel insert according to claim 1, wherein the barrel insert includes a compressible seal adjacent the proximal end.

11. The barrel insert according to claim 1, wherein in use the propellant gases communicate with the expansion volume defined by the proximal end side of the wall only from the proximal end of the engagement with the projectile.

12. The barrel insert according to claim 1, wherein the distal end includes a nose having a shape matching a shape of a nose of the projectile.

13. The barrel insert according to claim 1, further comprising a pillar for supporting the distal end in position, a flange toward the proximal end of the pillar, and a spigot surrounded by a compressible seal on the proximal end of the flange.

14. A method of firing a plurality of axially stacked projectiles from a single barrel, each projectile associated with a discrete selectively ignitable propellant charge, the method including the steps of:

stacking the projectiles axially in the barrel, the barrel and projectiles together defining discrete expansion volumes for each propellant charge, providing a volume behind a wall across the barrel behind the rearmost projectile in the barrel, said volume predetermined to be larger than the expansion volumes defined for the other projectiles to minimize muzzle velocity variation between the rearmost projectile and the other projectiles in the barrel; and firing the projectiles sequentially.

15. A method according to claim 14, wherein the step of providing the volume includes the step of inserting a barrel insert including the wall into the barrel to locate the rearmost projectile in a predetermined position in the barrel.

16. A method according to claim 14, wherein the step of providing the volume includes the step of providing a barrel closure including the wall behind the rearmost projectile, wherein the barrel closure at least partially defines the volume.

17. A method of configuring a stacked projectile launcher, the launcher having a barrel with a plurality of axially stacked projectiles, each projectile associated with a discrete selectively ignitable propellant charge, the barrel and projectiles together defining discrete expansion volumes for each propellant charge, said method including the step of providing a volume behind a wall across the barrel behind the rearmost projectile in the barrel, said volume predetermined to be proportional to the expansion volumes defined for the other projectiles to minimize muzzle velocity variation between the projectiles when each propellant charge is ignited.

18. A method according to claim 17, wherein the step of providing the volume includes the step of inserting a barrel insert including the wall into the barrel to locate the rearmost projectile in a predetermined position in the barrel.

19. A method according to claim 17, wherein the step of providing the volume includes the step of providing a barrel closure including the wall behind the rearmost projectile, wherein the barrel closure at least partially defines the volume.

* * * * *